US006930694B2

(12) United States Patent
Weitbruch et al.

(10) Patent No.: US 6,930,694 B2
(45) Date of Patent: Aug. 16, 2005

(54) ADAPTED PRE-FILTERING FOR BIT-LINE REPEAT ALGORITHM

(75) Inventors: Sébastien Weitbruch, Mönchweiler (DE); Carlos Correa, Villingen-Schwenningen (DE); Rainer Zwing, Villingen-Schwenningen (DE)

(73) Assignee: Thomson Licensing S.A., Boulogne-Billancourt (FR)

( * ) Notice: Subject to any disclaimer, the term of this patent is extended or adjusted under 35 U.S.C. 154(b) by 425 days.

(21) Appl. No.: 10/125,199

(22) Filed: Apr. 18, 2002

(65) Prior Publication Data

US 2003/0020737 A1 Jan. 30, 2003

(30) Foreign Application Priority Data

Apr. 27, 2001 (EP) ..... 01250151

(51) Int. Cl.[7] ..... G09G 5/10; G09G 3/26
(52) U.S. Cl. ..... 345/690; 345/63; 345/691
(58) Field of Search ..... 345/60–72, 690–692; 315/169.1–169.4

(56) References Cited

U.S. PATENT DOCUMENTS 6,144,364 A 11/2000 Otobe et al.
6,151,001 A * 11/2000 Anderson et al. ..... 345/63
6,340,961 B1 * 1/2002 Tanaka et al. ..... 345/63
6,373,477 B1 * 4/2002 Van Dijk ..... 345/204
6,630,917 B1 * 10/2003 Van Dijk ..... 345/60

FOREIGN PATENT DOCUMENTS

EP 874349 10/1998
EP 1058229 12/2000

* cited by examiner

*Primary Examiner*—Amr A. Awad
(74) *Attorney, Agent, or Firm*—Joseph S. Tripoli; Harvey D. Fried; Sammy S. Henig

(57) ABSTRACT

When the observation point on a PDP screen moves, artifacts will be introduced which are commonly described as "dynamic false contour". A simple way to reduce this effect requires the use of more sub-fields at the expense of panel brightness. A first idea called Bit-Line-Repeat (BLR) makes it possible to exchange vertical resolution with addressing time in order to dispose of more sub-fields for the same brightness. Nevertheless, such a solution introduces some vertical artifacts mostly during movement. Therefore, before the step of sub-field encoding a vertically filtering of the picture divided into pixel blocks is performed, wherein each block includes at least one pixel in horizontal direction and a number of pixels corresponding to the number of common lines in vertical direction. The effect of the pre-filtering step is that the difference of brightness values within each pixel block is limited to a predetermined value. In that case the BLR introduces only a slight vertical loss free from motion artifacts.

8 Claims, 8 Drawing Sheets

| | | |
|---|---|---|
| *Line n* | 36 | |
| *Line n+1* | 51 | |

Prior Art

Fig. 8

Column C

| | | | |
|---|---|---|---|
| Line L | | $P_{L,C}$ | |
| Line L+1 | | $P_{L+1,C}$ | |
| Line L+2 | | $P_{L+2,C}$ | |
| Line L+3 | | $P_{L+3,C}$ | |
| Line L+4 | | $P_{L+4,C}$ | |
| Line L+5 | | $P_{L+5,C}$ | |

Consecutive pixels

Prior Art

Fig. 9

Column C

| | | | |
|---|---|---|---|
| Line L | | 52 | |
| Line L+1 | | 60 | |
| Line L+2 | | 86 | |
| Line L+3 | | 115 | |
| Line L+4 | | 128 | |
| Line L+5 | | 82 | |

Consecutive pixels

Prior Art

Fig. 10

ADAPTED PRE-FILTERING FOR BIT-LINE REPEAT ALGORITHM

The present invention relates to a method for processing video pictures for display on a display device.

BACKGROUND OF THE INVENTION

Though they are known for many years, plasma displays are encountering a growing interest from TV manufacturers. Indeed, this technology now makes it possible to achieve flat colour panels of large size (out of the CRT limitations) and with very limited depth without any viewing angle constraints. Referring to the last generation of European CRT-TV, a lot of work has been done to improve its picture quality. Consequently, a new technology like Plasma has to provide a picture quality at least as good or even better than the old standard CRT-TV technology. On the one hand, the Plasma technology gives the possibility of "unlimited" screen size, of attractive thickness etc. but on the other hand it generates new kinds of artefacts that could degrade the picture quality. Most of these artefacts are different from those of CRT-TV pictures that make them more visible since people are used of seeing the old TV artefacts unconsciously.

The principle structure of a plasma cell in the so-called matrix plasma technology is shown in FIG. 1. Reference number 10 denotes a face plate made of glass, with reference number 11 a transparent line electrode is denoted. The back plate of the panel is referenced with reference number 12. There are 2 dielectric layers 13 for isolating face and back plate against each other. In the back plate column electrodes 14 are integrated being perpendicular to the line electrodes 11. The inner part of the cells consists of a luminance substance 15 (phosphorous) and separator 16 for separating the different coloured phosphorous substances (green 15*a*) (blue 15*b*) (red 15*c*). The UV radiation caused by the discharge is denoted with reference number 17. The light emitted from the green phosphorous 15*a* is indicated with an arrow having the reference number 18. From this structure of a PDP cell it is clear that there are three plasma cells necessary, corresponding to the three colour components RGB to produce the colour of a picture element (pixel) of the displayed picture.

The grey level of each R, G, B component of a pixel is controlled in a PDP by modulating the number of light pulses per frame period. The eye will integrate this time modulation over a period corresponding to the human eye response. The most efficient addressing scheme should be to address n times if the number of video levels to be created is equal to n. In case of the commonly used 8 bit representation of the video levels, a plasma cell should be addressed 256 times according to this. But this is not technically possible, since each addressing operation requires a lot of time (around 2 $\mu$s per line>960 $\mu$s for one addressing period>245 ms for all 256 addressing operations), which is more than the 20 ms available time period for 50 Hz video frames.

From the literature a different addressing scheme is known, which is more practical. According to this addressing scheme a minimum of 8 sub-fields (in case of an 8 bit video level data word) are used in a sub-field organization for a frame period. With a combination of these 8 sub-fields it is possible to generate the 256 different video levels. This addressing scheme is illustrated in FIG. 2. In this figure each video level for each colour component will be represented by a combination of 8 bits with the following weights:

1/2/4/8/16/32/64/128

To realize such a coding with the PDP technology, the frame period will be divided in 8 lighting periods called sub-fields, each one corresponding to a bit in a corresponding sub-field code word. The number of light pulses for the bit "2" is double as for the bit "1" and so forth. With these 8 sub-periods it is possible, through sub-field combination, to build the 256 grey levels. The standard principle to generate this grey level rendition is based on the ADS (Address Display Separated) principle, where all operations are performed at different times on the whole display panel. At the bottom of FIG. 2 it is shown that in this addressing scheme each sub-field consists of three parts, namely an addressing period, a sustaining period and an erasing period.

In the ADS addressing scheme all the basic cycles follow one after the other. At first, all cells of the panel will be written (addressed) in one period, afterwards all cells will be lighted (sustained) and at the end all cells will be erased together.

The sub-field organization shown in FIG. 2 is only a simple example and there are very different sub-field organizations known from the literature with e.g. more sub-fields and different sub-field weights. Often more sub-fields are used to reduce moving artefacts and "priming" could be used on more sub-fields to increase the response fidelity. Priming is a separate optional period, where the cells are charged and erased. This charge can lead to a small discharge, i.e. can create background light, which is in principle unwanted. After the priming period an erase period follows for immediately quenching the charge. This is required for the following sub-field periods, where the cells need to be addressed again. So priming is a period, which facilitates the following addressing period, i.e. it improves efficiency of the writing stage by regularly exciting all cells simultaneously. The addressing period length can be equal for all sub-fields, also the erasing period length. However, it is also possible that the addressing period length is different for a first group of sub-fields and a second group of sub-fields in a sub-field organization. In the addressing period, the cells are addressed line-wise from line 1 to line n of the display. In the erasing period all the cells will be discharged in parallel in one shot, which does not take as much time as for addressing. The example in FIG. 3 shows the standard sub-field organisation with 8 sub-fields inclusive the priming operation. At one point in time there is one of these operations active for the whole panel.

This light emission pattern introduces new categories of image-quality degradation corresponding to disturbances of grey levels and colours. These will be defined as dynamic false contour since they correspond to the apparition of coloured edges in the picture when an observation point on the PDP screen moves. Such errors on a picture lead to the impression of strong contours appearing on homogeneous area like skin. The degradation is enhanced when the image has a smooth gradation and also when the light-emission period exceeds several milliseconds. In addition, the same problems occur on static images when observers are shaking their heads and that leads to the conclusion that such errors depend on the human visual perception. To understand a basic mechanism of visual perception of moving images, a simple case with a transition between the levels 128 and 127 moving at 5 pixel per frame, the eye following this movement, will be considered.

FIG. 4 represents in dark grey the lighting sub-fields corresponding to the level 128 and in grey, these corresponding to the level 127 with a standard 8 sub-field encoding.

On FIG. 4 one can follow the behaviour of the eye integration during a movement. The two extreme diagonal eye-integration-lines show the limits of the faulty perceived signal. Between them, the eye will perceive a lack of luminance that leads to the appearing of a dark edge shown in FIG. 5.

Instead of the standard 8 sub-field coding, we can choose a new coding scheme using more sub-fields as demonstrated in FIG. 6 showing a sub-field organisation with 12 sub-fields.

FIG. 7 shows the influence of the different sub-field organisation on the light generation in case of the 128/127 transition moving at 5 pixel per frame.

Furthermore, this figure shows the impact of the new coding on the false contour effect in the case of the 128/127 transition, in which the minimum video level perception on the retina is enhanced a lot from 0 to 123. Consequently, the number of sub-fields would have to be increased and then the picture quality in case of motion will be improved, too. Nevertheless an increasing of the sub-field number is limited according to the following relation:

$$(1)\ n_{SF} \times NL \times T_{ad} + T_{Light} \leqq T_{Frame}$$

where $n_{SF}$ represents the number of sub-fields, NL the number of lines, $T_{ad}$ the duration to address one sub-field per line, $T_{Light}$ the lighting duration of the panel and $T_{Frame}$ the frame period. Obviously, an increasing of the sub-field number will reduce the time $T_{Light}$ to light the panel and consequently, will reduce the global brightness and contrast of the panel.

A first idea, called Bit-Line Repeat Principle (BLR), is to reduce, for some sub-fields named common sub-fields, the number of lines to be addressed by grouping k consecutive lines together. In that case the previous relation (1) is modified to the following one:

$$n_{CommonSF} \times \frac{NL}{k} \times T_{ad} + n_{SpecificSF} \times T_{ad} + T_{Light} \leq T_{Frame} \quad (2)$$

where $n_{commonSF}$ represents the number of common sub-fields, $n_{SpecificSF}$ represents the number of specific sub-fields and k the number of consecutive lines having the same sub-fields in common.

The following example serves for demonstrating BLR-encoding in more detail with k=2. Assuming that only 9 sub-fields can be addressed with the current panel an acceptable contrast ratio will be achieved, but with 9 sub-fields, the false contour effect will stay very disturbing. Taking into account the previous sub-field coding of FIG. 6 and 7 that has a quite good behaviour concerning the false contour issue. In this coding scheme 6 independent sub-fields and 6 common sub-fields will be chosen, then the previous relation (2) becomes:

$$6 \times \frac{NL}{2} \times T_{ad} + 6 \times NL \times T_{ad} + T_{Light} = 9 \times NL \times T_{ad} + T_{Light} \leq T_{Frame} \quad (3)$$

which is equivalent to the relation in case of a 9 Sub-field coding. Consequently, with such a Bit-Line Repeat coding, we will artificially dispose of 12 sub-fields with the same amount of light pulses as with 9 sub-fields (same brightness and contrast). We will represent this example of Bit-Line Repeat coding as following:

$\underline{1}$–$\underline{2}$–$\underline{4}$–5–$\underline{8}$–10–$\underline{15}$–20–$\underline{30}$–40–50–70 in which the underlined values represent the common sub-fields values. In that case, the values of these common sub-fields will be the same between each pixel of two consecutive lines since we have chosen k=2. Let us take an example of the values 36 and 51 located at the same horizontal position on two consecutive lines as shown in FIG. 8.

There are different possibilities to encode these values (the codes in brackets represent the corresponding codes for the 6 common sub-fields, with the LSB at the right side):

$$\begin{aligned}
36 &= \underline{30} + \underline{4} + \underline{2}\ (100110)\\
&= \underline{30} + 5 + \underline{1}\ (100001)\\
&= 20 + \underline{15} + \underline{1}\ (010001)\\
&= 20 + 10 + 5 + \underline{1}\ (000001)\\
&= 20 + 10 + \underline{4} + \underline{2}\ (000110)\\
&= 20 + \underline{8} + 5 + \underline{2} + \underline{1}\ (001011)\\
&= \underline{15} + 10 + \underline{8} + \underline{2} + \underline{1}\ (011011)\\
&= \underline{15} + 10 + 5 + \underline{4} + \underline{2}\ (010110)
\end{aligned}$$

$$\begin{aligned}
51 &= 50 + \underline{1}\ (000001)\\
&= 40 + 10 + \underline{1}\ (000001)\\
&= 40 + \underline{8} + \underline{2} + \underline{1}\ (001011)\\
&= 40 + 5 + \underline{4} + \underline{2}\ (000110)\\
&= \underline{30} + 20 + \underline{1}\ (100001)\\
&= \underline{30} + 10 + \underline{8} + \underline{2} + \underline{1}\ (101011)\\
&= \underline{30} + 10 + 5 + \underline{4} + \underline{2}\ (100110)\\
&= 20 + \underline{15} + 10 + 5 + \underline{1}\ (010001)\\
&= 20 + \underline{15} + 10 + \underline{4} + \underline{2}\ (010110)\\
&= 20 + \underline{15} + \underline{8} + 5 + \underline{2} + \underline{1}\ (011011)
\end{aligned}$$

For this example one could find a way to encode these two values without any error (no loss of vertical resolution) in case of Bit-Line Repeat (same coding on common sub-fields=same values in brackets):

| | | | | | | |
|---|---|---|---|---|---|---|
| 36 | = | $\underline{30} + \underline{4} + \underline{2}$ | and | 51 | = | $\underline{30} + 10 + 5 + \underline{4} + \underline{2}$ |
| 36 | = | $\underline{30} + 5 + \underline{1}$ | and | 51 | = | $\underline{30} + 20 + \underline{1}$ |
| 36 | = | $20 + \underline{15} + \underline{1}$ | and | 51 | = | $20 + \underline{15} + 10 + 5 + \underline{1}$ |
| 36 | = | $20 + 10 + 5 + \underline{1}$ | and | 51 | = | $50 + \underline{1}$ |
| 36 | = | $20 + 10 + 5 + \underline{1}$ | and | 51 | = | $40 + 10 + \underline{1}$ |
| 36 | = | $20 + 10 + \underline{4} + \underline{2}$ | and | 51 | = | $40 + 5 + \underline{4} + \underline{2}$ |
| 36 | = | $20 + \underline{8} + 5 + \underline{2} + \underline{1}$ | and | 51 | = | $40 + \underline{8} + \underline{2} + \underline{1}$ |
| 36 | = | $\underline{15} + 10 + \underline{8} + \underline{2} + \underline{1}$ | and | 51 | = | $20 + \underline{15} + \underline{8} + 5 + \underline{2} + \underline{1}$ |
| 36 | = | $\underline{15} + 10 + 5 + \underline{4} + \underline{2}$ | and | 51 | = | $20 + \underline{15} + 10 + \underline{4} + \underline{2}$ |

Nevertheless, there are some cases in which an error has to be made due to the reduced flexibility in encoding produced by the need to have the same coding for each common sub-field. For instance, the values 36 and 52 have to be replaced by 36 and 51 or 37 and 52 to have the same code on common sub-fields. In addition, since there are common values between two consecutive lines, the biggest difference between these two lines can only be achieved through the non-common sub-field. That means, for our example, that the maximum vertical transition in the picture is limited to 195. This limitation introduces a reduction of the vertical resolution combined with new artefacts studied below.

The relation (2) presents a main condition of the global BLR concept based on k (k≧2) common lines. For the following explanations, it is assumed that we dispose of 7 standard sub-fields and k=6 is chosen. FIG. 9 illustrates this concept. The six pixels located at the same horizontal position but on six consecutive lines will be encoded with the same common sub-fields but their specificity will be encoded with the specific sub-fields.

The following BLR code with 256 levels will be used as example:

1–2–4–5–8–10–15–20–30–40–50–70

The underlined values represent the common values. This code has the time cost of 7 standard sub-fields (6 specific with normal addressing time +6 common with a sixth of the addressing time) but improves the grey-scale rendition as the false contour behaviour of the panel. The maximal transition possible in these 6 common lines is limited by the sum of the specific values (Σ=195). Consequently, there is still a loss of resolution in the picture but this can be optimised with a dedicated encoding algorithm. The precise specification of the BLR encoding principle has been presented in previous European Patent Applications (EP-A-0874349, EP-A-0874348, EP-A-0945846, WO-A-00/25291, EP-A-1058229 and PCT/FR00/02498). Nevertheless, the following gives an overall presentation of the encoding algorithm:

① In the amount of k values, select the smallest and biggest values Vmax and Vmin.

② Modify these two values to have a difference D=(Vmax'–Vmin') as multiple of five.

③ Modify all values which have a difference with Vmin' which is higher than the maximal available transition (Σ of specific values=$SPE_{max}$) to Vmin'+$SPE_{max}$. These new values will be the new highest video value Vmax".

④ Encode the new maximal value as a standard video value without taking into account the BLR concept.

⑤ Check that the sum of all common values from Vmax" is smaller than Vmin'. If it is not the case, replace the common value from Vmax" by the common values needed to encode Vmin'. These common values will be used for the encoding of all values. The code will be called COM_PART since it corresponds to the code based on common sub-fields (i.e. common part) only.

⑥ Encode all the values taking into account this common part COM_PART.

An example shown in FIG. 10 will help to illustrate this algorithm.

The following encoding steps are performed:

① Vmax=128 and Vmin=52.

② Vmax'=127 and Vmin'=52 with a difference D=(Vmax'–Vmin')=75=5×15.

③ Nothing to do.

④ 127=1+2+4+5+10+15+20+30+40

⑤ COM_PART=1+2+4+15+30=52. In this example, COMP_PART (52)≦Vmin'(52)

⑥ Encoding of all values:

52⇨1+2+4+15+30=52 [no error]

60⇨1+2+4+10+15+30=62 [error=2]

86⇨1+2+4+5+10+15+20+30=87 [error=1]

115⇨1+2+4+5 +15+20+3040=117 [error=2]

128⇨1+2+4+5 +10+15+20+30+127 [error=1]

82⇨1+2+4+10+15+20+30=82 [no error]

In the previous example, one can see that the lack of freedom coming from the BLR algorithm will introduce some errors in the encoding of the original values. This can lead to the introduction of a new noise in the picture that is one of the compromises needed to improve the grey-scale rendition as well as the false contour behaviour. Nevertheless, the most artefacts are introduced by the limitation in the vertical resolution.

SUMMARY OF THE INVENTION

A new artefact is introduced by the BLR vertical limitation.

The maximal vertical resolution available on a group of two common lines when k=2 (BLR lines having the same common sub-fields) is given by the sum of the specific sub-fields. A vertical transition 3⇔249 shall serve as example. According to the BLR principle the vertical transitions are limited by the value 195 in this example (sum of specific weights). Consequently, in order to encode the transition 3⇔249 (Δ=246) an error of 246–195=51 has to be accepted. This error will be put on the high video level only to reduce its visibility for the eye and so the transition 3⇔249 will be coded as follows:

3=2+1 and 249≈198=70+50+40+20+10+5+2+1

This encoding error will happen for each such transition located on two consecutive common lines. FIG. 11 shows an example of such an error generation in the case of a transition between two objects (black and white) and shows concretely the generation of new artefacts on the transition between two objects, a black one with video value 3 and a white one with video value 249. When the transition black to white occurs on two common lines of one line pair, the transition will be replaced by a transition black to grey (level 198). If the transition happens between two lines belonging to different line pairs, the transition will stay perfect (3⇔249). This will introduce artefacts in the picture, mostly during movement as shown on FIG. 12. In case of movement with odd amplitude in vertical direction, the artificial values generated by the BLR encoding on the transition will change since the transitions are not staying at the same vertical position (in a group of two common lines or between two groups of two common lines). That leads to an annoying moving noise.

The maximal vertical resolution available on a group of six common lines in case of k=6 (BLR lines having the same common sub-fields) is given by the sum of the specific sub-fields.

In the case of k=6 presented in FIG. 13, one can see the artefacts generated by a BLR implemented on 6 consecutive lines. For these 6 lines, it is not possible to represent a full vertical black-to-white transition (limited by the specific weights). This will be replaced by a black-to-gray transition having an independent geometrical structure (the same transition for all groups of 6 lines having the same black-to-white transition). This is really disturbing since it does not respect the original picture structure.

In order to reduce artefacts on plasma screens sometimes it is suggested to use a pulse equalization technique: This technique is a more complex one. It utilizes equalizing pulses that are added or subtracted from the TV signal when disturbances of grey scales are foreseen. In addition, since the fact that the false contour effect is motion relevant, different pulses for each speed are necessary. That leads to a need to store big LUTs (Look Up Tables) for each speed and a motion estimator is needed as well. Furthermore, since the false contour depends on the sub-field organization, the pulses have to be re-calculated for each new sub-field organization. However, the disadvantages of such a technique come from the fact that errors are added in the picture to compensate failures appearing on the eye retina. On the other hand, when the speed is increasing, more pulses are necessary and that leads to conflicts with the picture contents in case of very fast speed.

Furthermore, other dynamic algorithms are suggested. These algorithms based on motion estimation will provide very good false contour reduction without any loss of vertical resolution. However, this algorithm is more complicated and needs the development of a well-adapted motion estimator. This could take a long time and needs more die-size in an IC.

According to the above-described problems it is the object of the present invention to reduce the false contour effect particularly when using the bit-line repeat algorithm.

The claimed technique based on adapted pre-filtering aims to improve the picture quality in terms of vertical resolution, noise and reduction of introduced artificial structures.

BRIEF DESCRIPTION OF THE DRAWINGS

The present invention will be described in more details in connection with the attached drawings. In the figures:

FIG. 8 illustrates the grouping of two consecutive pixel lines for addressing purpose according to the bit-line repeat method;

FIG. 9 illustrates the concept of the general BLR algorithm on k lines with k=6;

FIG. 10 shows an example for BLR encoding according to the concept of FIG. 9;

DETAILED DESCRIPTION OF PREFERRED EMBODIMENTS

An embodiment of the present invention is described in connection with FIGS. 14 to 17. The pre-filtering method for reducing the BLR vertical artefacts is based on a kind of vertical pre-filtering, which will adapt an error to the picture structure. In fact, all the vertical strong transitions located in the picture will be limited depending on the BLR vertical limitation (e.g. 195 in our example) and depending on the BLR specification (number of common lines k). The principle is shown on FIGS. 14 and 15 for different k values.

Figure 1:
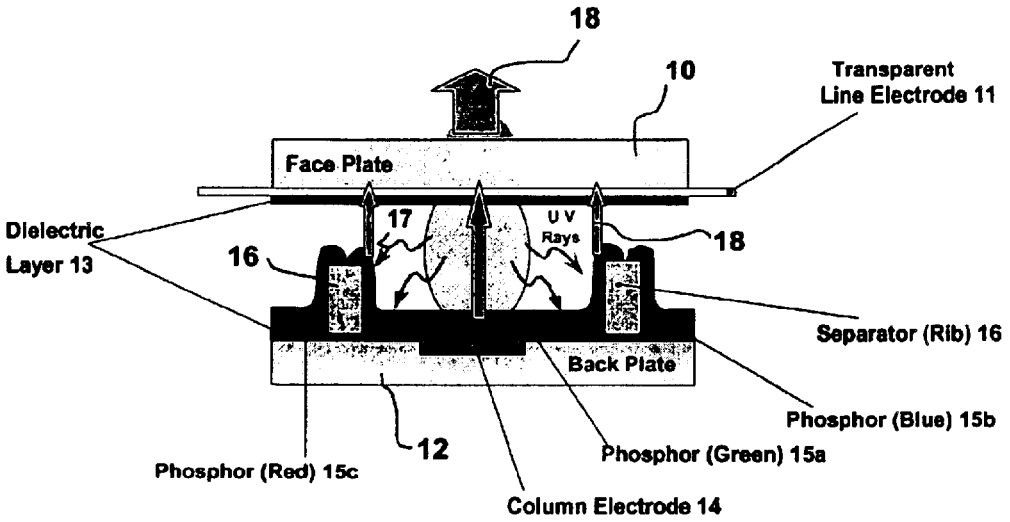
Prior Art Fig. 1
FIG. 1 shows the cell structure of the plasma display panel in the matrix technology.
Figure 2:
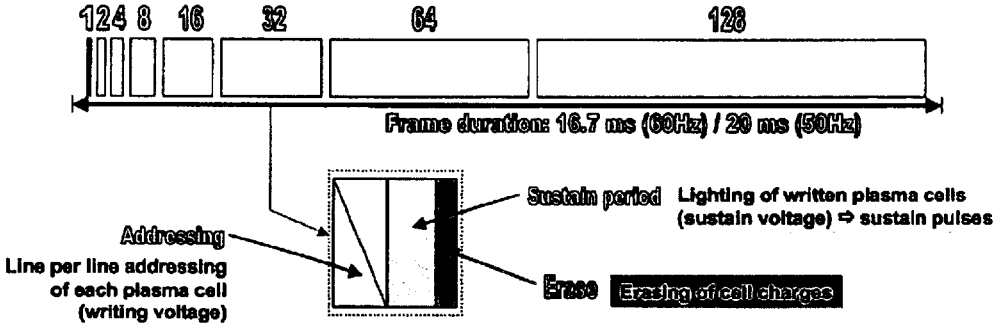
Fig. 2 Prior Art
FIG. 2 shows the conventional ADS addressing scheme during a frame period.
Figure 3:
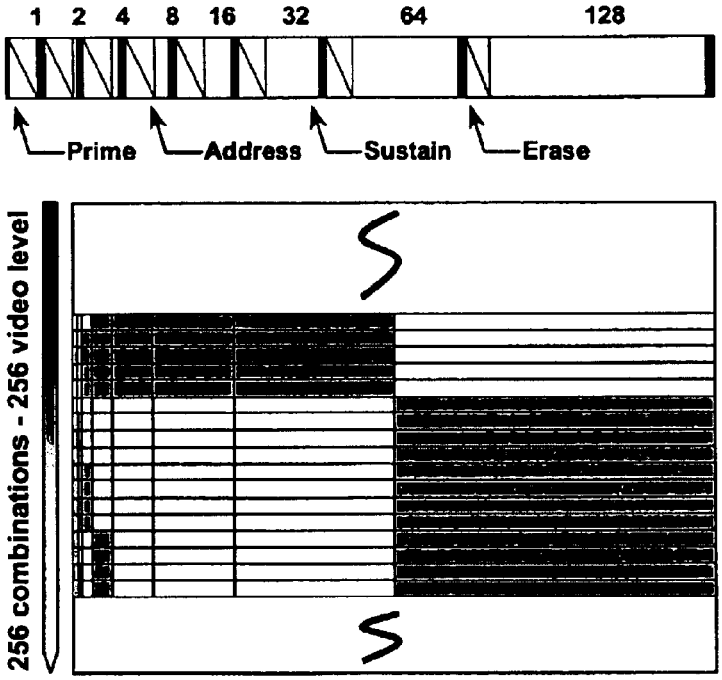
Fig. 3 Prior Art
FIG. 3 shows the standard sub-field encoding principle.
Figure 4:
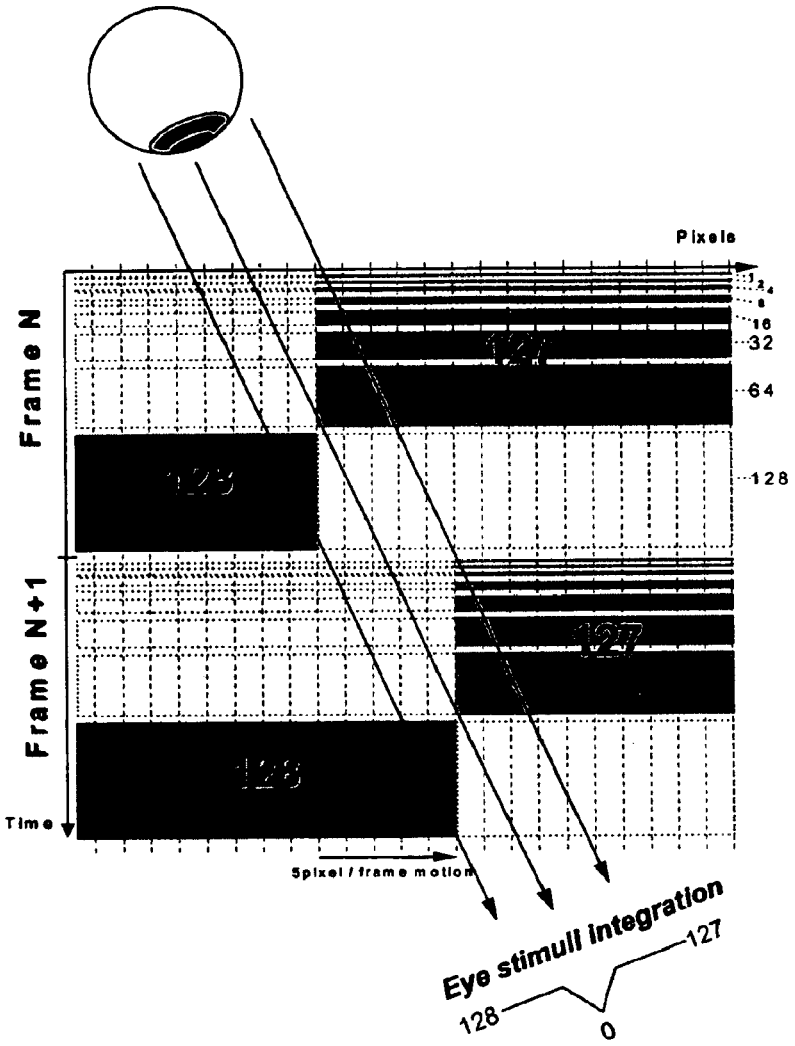
Fig. 4 Prior Art
FIG. 4 shows an illustration for explaining the false contour effect.
Figure 5:
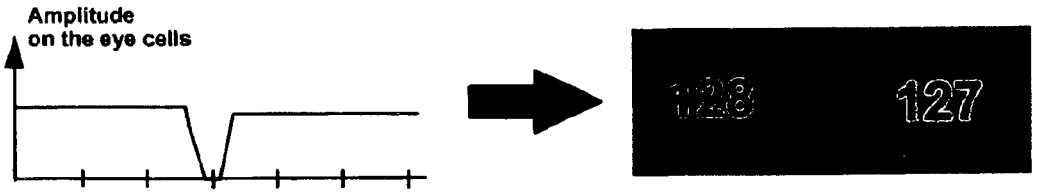
Fig. 5 Prior Art
FIG. 5 illustrates the appearance of a dark edge when a display of frames is being made in the manner shown in FIG. 3.
Figure 6:
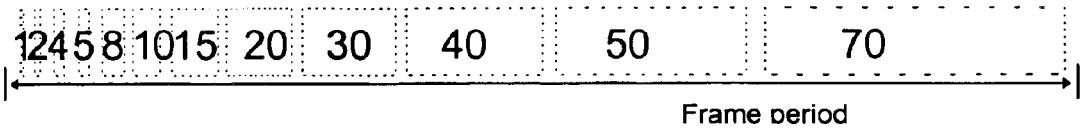
FIG. 6 shows a refined sub-field organisation.
Figure 7:
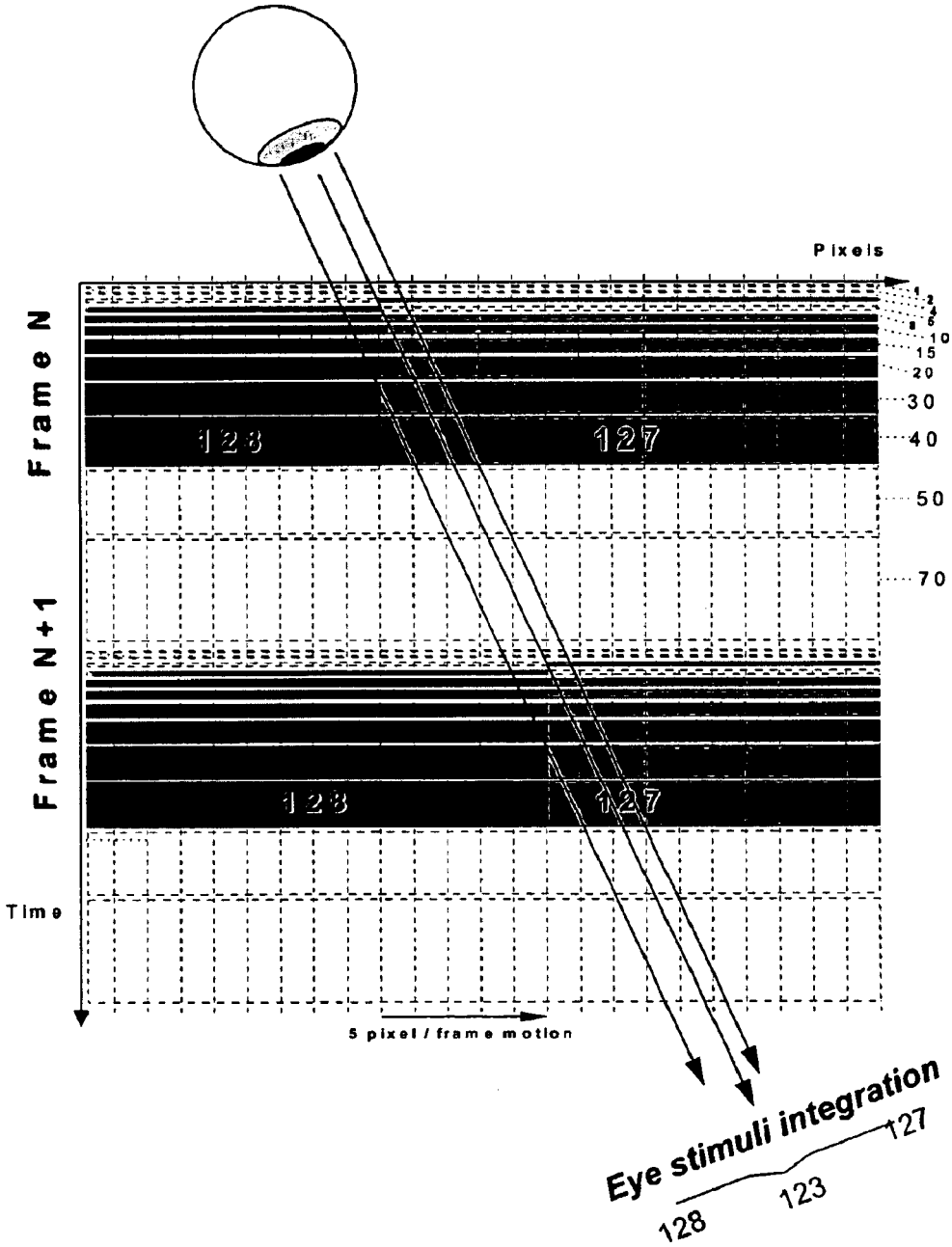
FIG. 7 shows the illustration of FIG. 3 but with a sub-field organisation according to FIG. 5.
Figure 11:
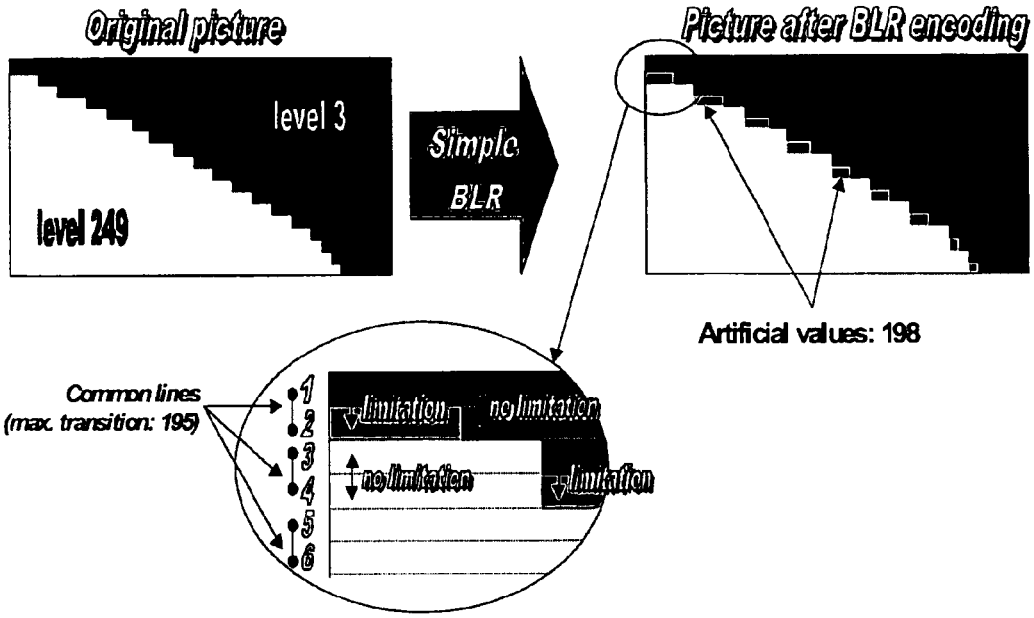
FIG. 11 shows an example of BLR artefacts with k=2.
Figure 12:
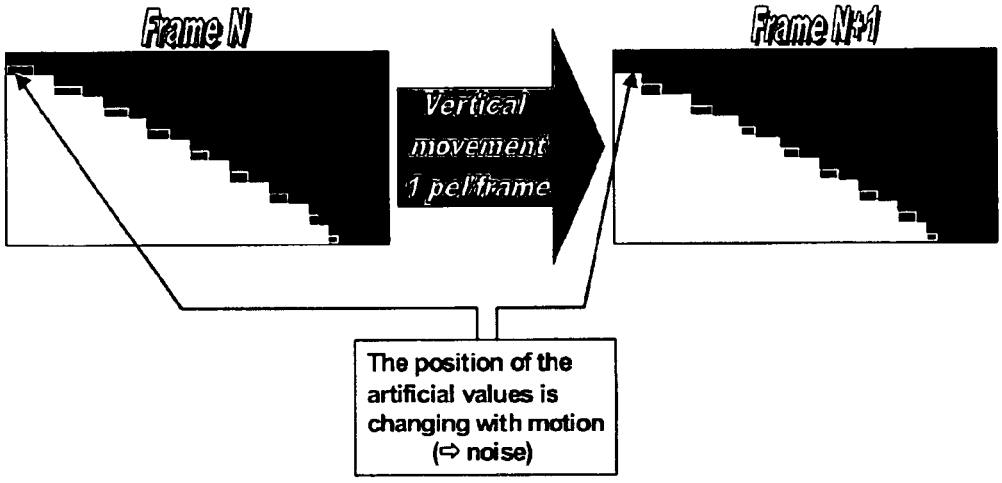
FIG. 12 illustrates an example of BLR artefacts (k=2) in case of movement.
Figure 13:
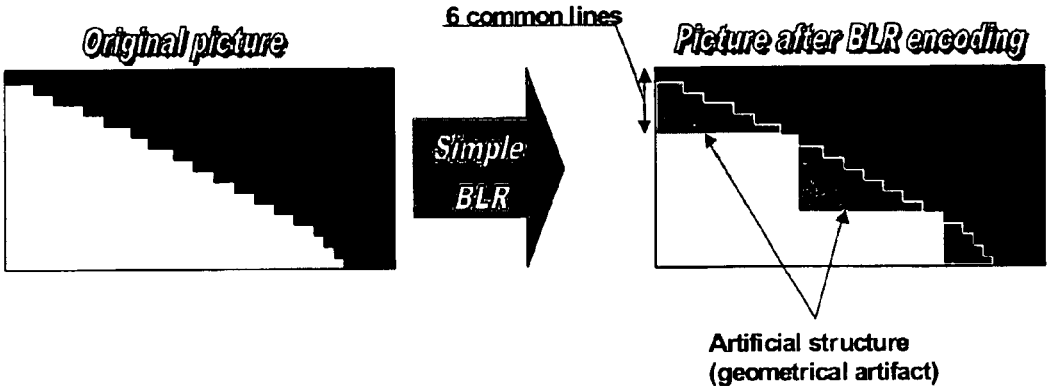
FIG. 13 shows an example of BLR artefacts with k=6.
Figure 14:
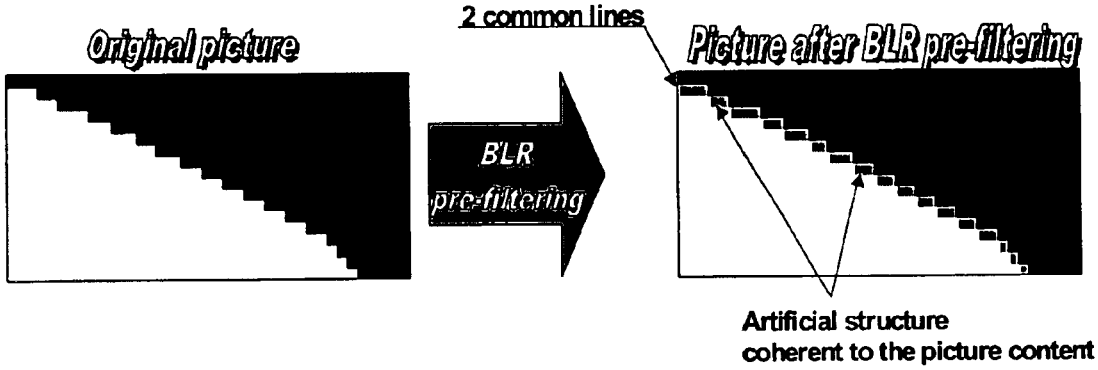
FIG. 14 shows a special BLR pre-filtering with k=2 according to the present invention.
Figure 15:
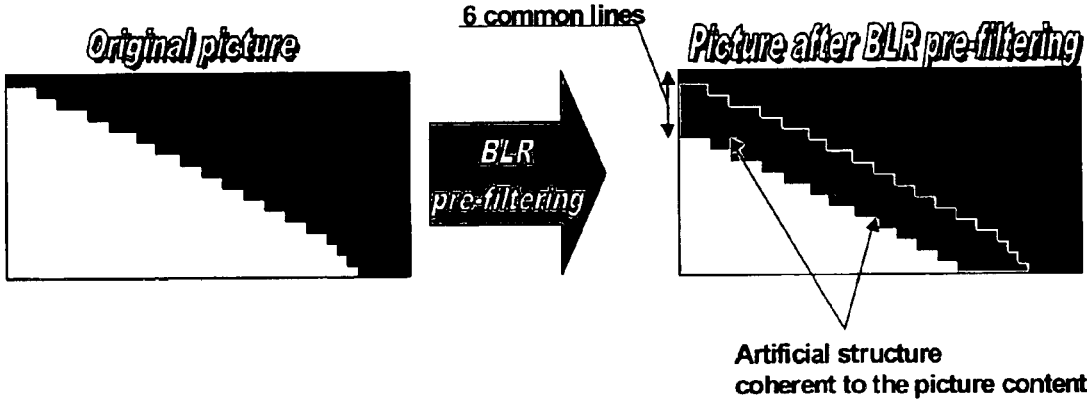
FIG. 15 shows the special BLR pre-filtering with k=6.

In the examples on FIGS. 14 and 15, there is an error in the picture representation but thanks to the pre-filtering, this error stays coherent with the picture content. In other words, this error will look like a loss of sharpness but will not be seen as an artificial artefact. This prefiltering will avoid any limitation occurring during the BLR picture encoding, corresponding to the test ③ from the BLR algorithm description. In addition, the different movements occurring in the picture will not change the result of this pre-filtering leading to a stable encoded picture. This prefiltering is based on a vertical filter having the size of the value k from BLR (e.g. 2 or 6 taps filter in the two examples). This filter will process each group of consecutive lines independently of the BLR grouping. For each filtered group of lines, there will be a limitation of the maximal vertical resolution depending on the BLR limitation (e.g. 195 in the BLR example).

Figure 16:
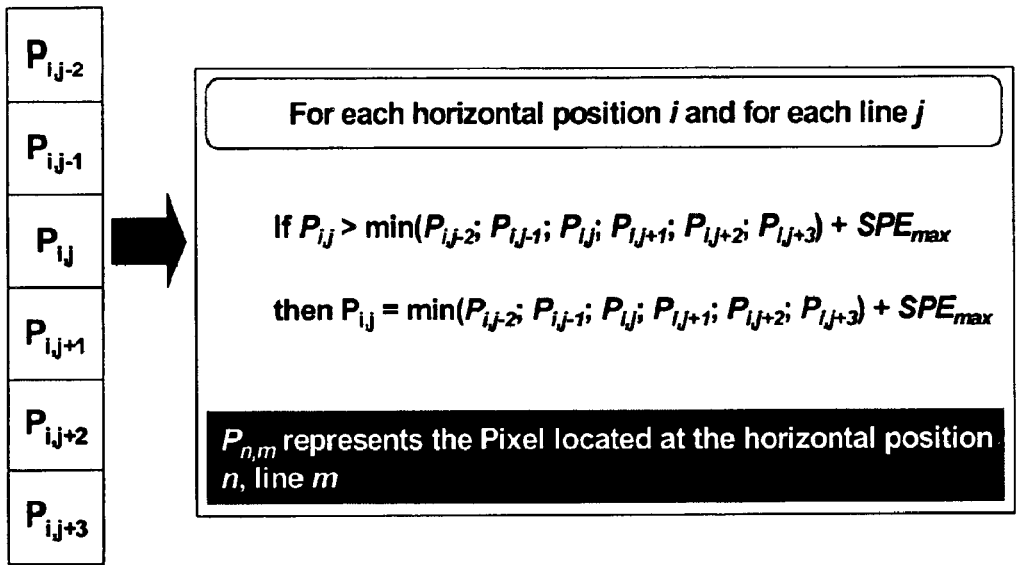
FIG. 16 illustrates an implementation of BLR pre-filtering.

The filtering principle can be described with k=6 as shown in FIG. 16. In this example, the number of taps for the filter has been set to 6 to match our BLR example with k=6. Obviously, this number can change and is related to the chosen BLR mode. The value $SPE_{max}$ represents the maximal vertical resolution from BLR (Σ specific weights, 195 in the example). The complete filtering algorithm can be described as following:

```
For each pixel i
    {
        For each line j
        {
            ValueMin = 255;
            For (t=0; t<k; t++)
            {
                ValueMin = min(ValueMin; P_{i,j+t})
            }
            For (t=0; t<k; t++)
            {
                if |ValueMin − P_{i,j+t}| > SPE_max
                    then P_{i,j+t} = ValueMin + SPE_max
            }
        }
    }
```

In this algorithm description, k represents the number of common lines (e.g. 2 or 6 in the example) and $SPE_{max}$ the maximal vertical transition allowed by the BLR (e.g. 195 in the example). Afterwards, the standard BLR encoding algorithm will be used.

Figure 17:
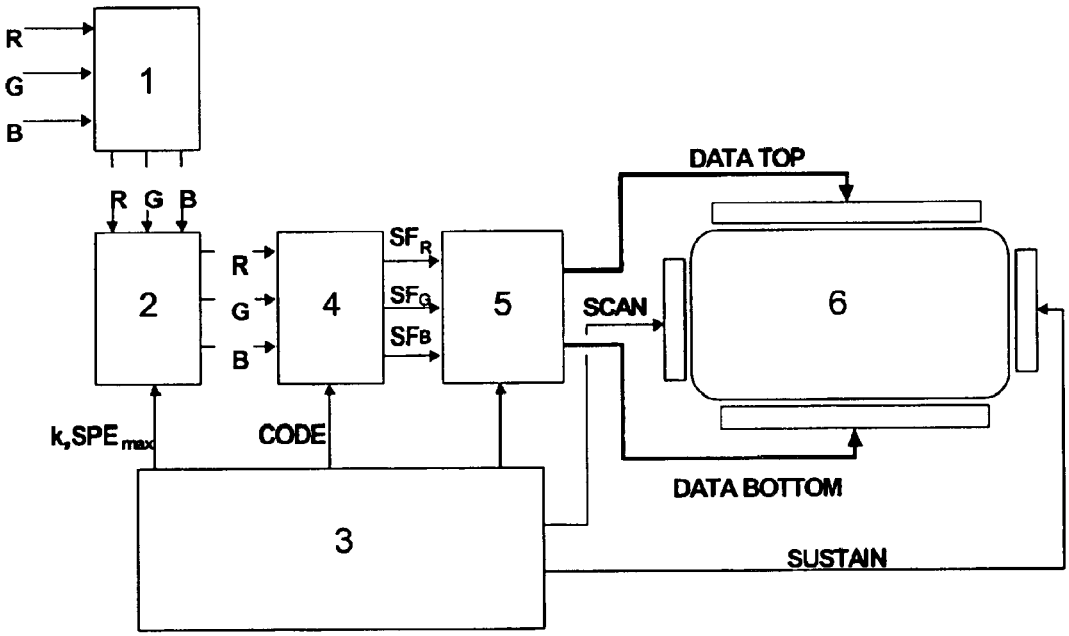
FIG. 17 shows a block diagram of a PDP.

FIG. 17 describes a possible circuit implementation of the present invention. RGB input pictures are forwarded to the degamma function unit 1. The outputs of this block are forwarded to the BLR pre-filtering block 2 which implements the vertical picture filtering depending on the value k and $SPE_{max}$ configured by the Plasma Control block 3. The same block will configure the BLR sub-field encoding block 4 to enable the right video encoding after the pre-filtering. The sub-field signals output from the BLR sub-field encoding block 4 are transmitted to a serial-parallel-converter 5. The converted signals are used to drive the plasma display panel 6. This system enables the use of different BLR modes depending for instance on the field repetition rate (60 Hz⇨standard BLR, 50Hz⇨specific EUTV-BLR). The pre-filtering block 2 has to be specified for the maximum available k value, which specifies the maximum of line memories needed for the filtering, (e.g. 6 line memory for k=6).

The advantages of the inventive algorithm are that it enables a strong reduction of the false contour effect since it enables to dispose artificially of more sub-fields without loss of contrast and without "visible" loss of vertical resolution. Furthermore, this algorithm reduces a lot the perceptive BLR-artefacts normally produced by the reduced available vertical resolution of standard BLR-algorithms. Additionally, this algorithm is very simple and could be implemented very quickly and so it could be seen as an alternative to more complex algorithms like dynamic false contour reduction that needs more efforts to be developed.

What is claimed:

1. A method for processing video pictures for display on a display device having a plurality of luminous elements, one or more of them corresponding to each of the pixels of a picture, wherein the time duration of a video frame or video field is divided into a plurality of sub-fields during which the luminous elements can be activated for light generation in small pulses corresponding to a sub-field code word ($SF_R$, $SF_G$, $SF_B$) which is used for brightness control, wherein for corresponding pixels of a predetermined number of two or more pixel lines sub-field code words are determined which have identical entries for a number of sub-fields called common sub-fields, comprising the steps of:

dividing the picture into pixel blocks, each block including at least one pixel in horizontal direction and a number of pixels corresponding to the predetermined number of two or more pixel lines in vertical direction, before the step of sub-field encoding vertically filtering the picture divided into pixel blocks, wherein the difference of brightness values within each pixel block is limited to a maximum allowed value therein, determining the minimum value of brightness of all pixels within a pixel block, and assigning the sum of the minimum value and the maximum allowed difference value to a pixel of the pixel block, if the difference between the minimum value and the brightness value of the pixel exceeds the maximum allowed difference value.

2. The method according to claim 1, wherein the maximum allowed difference value is the sum of the weights of all non-common sub-fields.

3. The method according to claim 1, wherein three luminous elements for red, green and blue colours are assigned to each pixel of a picture and the vertical filtering is made separately for each colour.

4. A device for processing video pictures for display on a display device having a plurality of luminous elements, one or more of them corresponding to each of the pixels of a picture, wherein the time duration of a video frame or video field is divided by sub-field coding means into a plurality of sub-fields during which the luminous elements can be activated for a light generation in small pulses corresponding to a sub-field code word which is used for brightness control, wherein for corresponding pixels of a predetermined number of two or more pixel lines sub-field code words are determined which have identical entries for a number of sub-fields called common sub-fields, said device comprising filtering means for vertically filtering the picture divided into pixel blocks, each block including at least one pixel in a horizontal direction and a number of pixels corresponding to the predetermined number of common lines in a vertical direction, said filtering means including a first limiter that limits the difference of brightness values within each pixel block to a maximum allowed value, determining means for determining the minimum brightness value of all pixels within a pixel block and a second limiter that assigns the sum of the minimum value and the maximum allowed difference value to a pixel of the pixel block, if the difference between the minimum value and the brightness value of the pixel exceeds the maximum allowed difference value, wherein the output of the filtering means is provided to the sub-field coding means.

5. The device according to claim 4, further including control means for providing the maximum allowed difference value as the sum of the weights of the specific sub-fields within the sub-field organisation without the weights of said common sub-fields.

6. The device according to claim 4, wherein three luminous elements for red, green and blue colours are assigned to each pixel of a picture.

7. A method for processing video pictures for display on a display device having a plurality of luminous elements, one or more of them corresponding to each of the pixels of a picture, wherein the time duration of a video frame or video field is divided into a plurality of sub-fields during which the luminous elements can be activated for a light generation in small pulses corresponding to a sub-field code word ($SF_R$, $SF_G$, $SF_B$) which is used for brightness control, wherein for corresponding pixels of a predetermined number of two or more pixel lines sub-field code words are determined which have identical entries for a number of sub-fields called common sub-fields, characterized by, before the step of sub-field encoding vertically filtering the picture divided into pixel blocks, each block including at least one pixel in horizontal direction and a number of pixels corresponding to the predetermined number of two or more pixel lines in vertical direction, wherein during vertical filtering the difference of brightness values within each pixel block is limited to a maximum allowed value;

wherein the maximum allowed difference value is the sum of the weights of all non-common sub-fields.

8. A device for processing video pictures for display on a display device having a plurality of luminous elements, one or more of them corresponding to each of the pixels of a picture, wherein the time duration of a video frame or video field is divided by BLR sub-field coding means into a plurality of sub-fields during which the luminous elements can be activated for a light generation in small pulses corresponding to a sub-field code word ($SF_R$, $SF_G$, $SF_B$) which is used for brightness control, wherein for corresponding pixels of a predetermined number of two or more pixel lines subfield code words are determined which have identical entries for a number of sub-fields called common subfields, said device comprising filtering means for vertically filtering the picture divided into pixel blocks, each block including at least one pixel in horizontal direction and a number of pixels corresponding to the predetermined number of common lines in vertical direction, said filtering means having a limiter that limits the difference of brightness values within each pixel block to a maximum allowed value, wherein the output of the filtering means is provided to the BLR subfield coding means; and, further comprising control means for providing the maximum allowed difference value as the sum of the weights of the specific sub-fields within the sub-field organization without the weights of said common sub-fields.

* * * * *